United States Patent [19]

Lo

[11] Patent Number: 4,826,167

[45] Date of Patent: May 2, 1989

[54] RACKET HAVING A CUSHIONING SHAFT PORTION

[76] Inventor: Pi-Tuan Lo, 96, Peiping Rd, Sec. 4,, Taichung, Taiwan

[21] Appl. No.: 141,089

[22] Filed: Jan. 5, 1988

[51] Int. Cl.[4] ..... A63B 49/10

[52] U.S. Cl. ..... 273/73 J; 273/73 G; 273/DIG. 4

[58] Field of Search ..... 273/73 J, 73 C, 73 D, 273/73 G, 73 H, 73 K, 73 R, DIG. 4, DIG. 7, DIG. 8, DIG. 16, DIG. 23

[56] References Cited

U.S. PATENT DOCUMENTS

| | | | |
|---|---|---|---|
| 1,828,109 | 10/1931 | Fox | 273/73 J |
| 2,097,616 | 11/1937 | Davis | 273/73 J |
| 4,725,059 | 2/1988 | DuGardin et al. | 273/73 J |

FOREIGN PATENT DOCUMENTS

| | | | |
|---|---|---|---|
| 3101687 | 8/1982 | Fed. Rep. of Germany | 273/73 J |
| 823727 | 10/1937 | France | 273/73 J |
| 854492 | 1/1940 | France | 273/73 J |

*Primary Examiner*—Maryann Lastova
*Attorney, Agent, or Firm*—Holman & Stern

[57] ABSTRACT

A racket includes a head portion having a striking netting, a shaft portion, a throat portion connected between the head portion and the shaft portion, a grip portion formed on the shaft portion from a bottom end thereof, but excluding the uppermost part of the shaft portion, and a cushioning device provided between the head portion and the grip portion to cushion the impact force occurring when one strikes a ball with the striking netting.

10 Claims, 3 Drawing Sheets

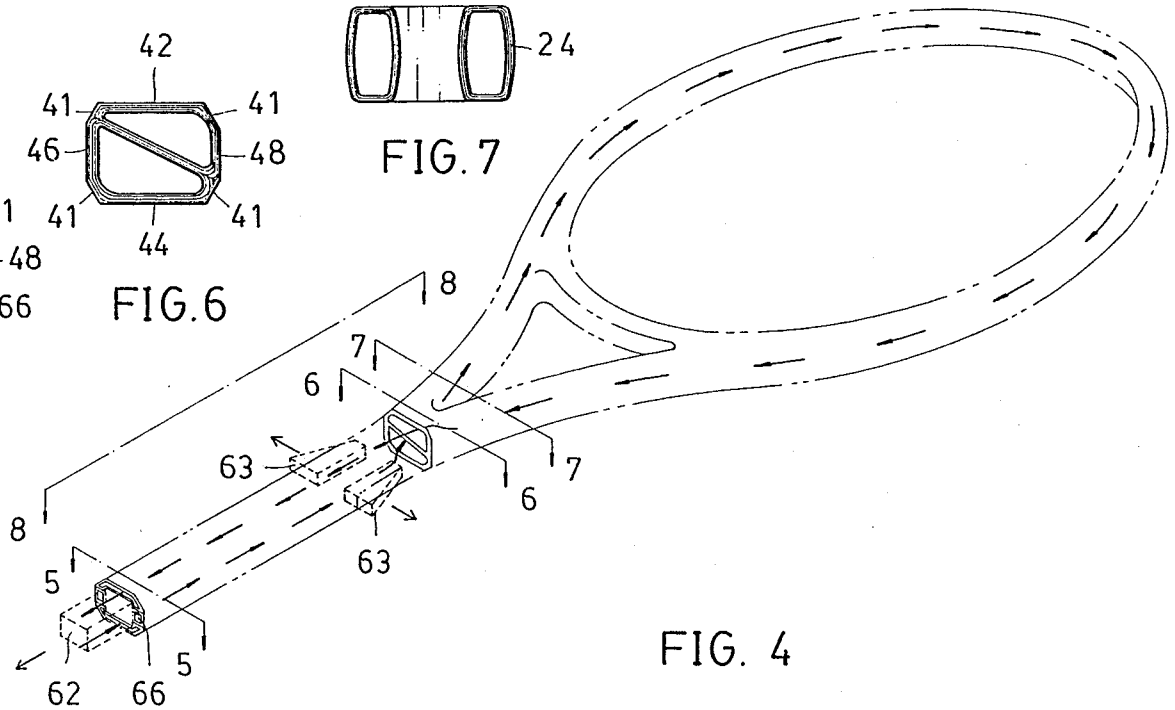
FIG. 4
FIG. 7
FIG. 6
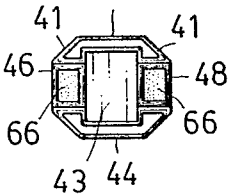
FIG. 5
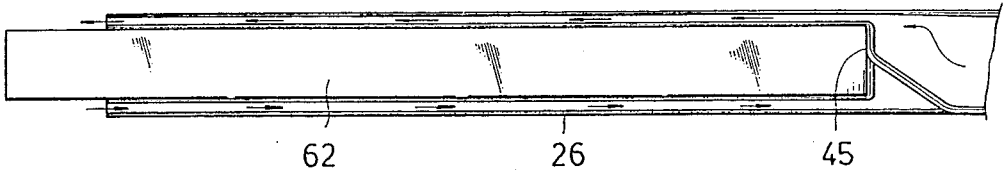
FIG. 8

RACKET HAVING A CUSHIONING SHAFT PORTION

BACKGROUND OF THE INVENTION

1. Field of the Invention

The present invention relates to a racket, and ore particularly to a racket that is fiber-reinforced.

2. Description of the Prior Art

As shown in FIG. 1, the known fiber reinforced racket 10 generally includes an elliptical head 11, the lower end of which terminates with two juxtaposed extending tubes to constitute thereabout a throat 12. A yoke 13 connected between head 11 and throat 12 cooperates with the frame of head 11 to form thereon a frame for a striking netting. The juxtaposed extending tubes constitute a shaft 14 of a racket. A grip 15 is formed around the major part of shaft 14 but excludes the uppermost part of shaft 14. So far as such racket is concerned, since shaft 14 is straight, the impact force when one strikes a ball with the striking netting will inevitably be transmitted, through head 11, throat 12 and shaft 14, to the arm of the user, thus incurring so called "tennis elbow." In addition, such racket has a "hard touch", not permitting him to have a smart control for the ball.

It is therefore an object of the invention to obviate the above shortcomings encountered by the prior art to the largest extent.

SUMMARY OF THE INVENTION

It is an object of the present invention to provide a racket capable of absorbing relatively large impact force to prevent the user's arm from being hurt due to vibration.

It is another object of the present invention to provide a racket which provides a "soft touch" for the user and enables him to have a smart control for the ball.

According to the present invention, a racket includes a head portion having a striking netting, a shaft portion, a throat portion connected between the head portion and the shaft portion, a grip portion formed on the shaft portion from a bottom end thereof, but excluding the uppermost part of the shaft portion, and a cushioning means provided between the head portion and the grip portion so as to cushion the impact force occurred while striking a ball with the striking netting.

The grip portion can include a first pair of spaced plates substantially parallel to the striking netting and a second pair of spaced plates substantially perpendicular to the striking netting and engaging respectively with the first pair of second plates so as to encompass therebetween a parallelepiped cavity.

The cushioning means can include a transverse through window provided on two side surfaces of the shaft portion corresponding to the second pair of spaced plates and around the uppermost part of the grip portion and a synthetic foamed core having a shape suitable to be received in the parallelepiped cavity and positioned around the uppermost part.

Preferably, the synthetic foamed core has a length in the longitudinal direction of the racket larger than that of the through window.

The synthetic foamed core can be of polyethelene elastic rubber.

BRIEF DESCRIPTION OF THE DRAWINGS

The present invention may best be understood through the following description with reference to the accompanying drawings.

FIG. 4 is a schematic view showing the compressed air flow upon manufacturing a racket according to the present invention;

FIG. 5 is a cross sectional view taken along line 5—5 in FIG. 4;

FIG. 6 is a cross sectional view taken along line 6—6 in FIG. 4;

FIG. 7 is a cross sectional view taken along line 7—7 in FIG. 4;

FIG. 8 is a cross sectional view taken along line 8—8 in FIG. 4;

DETAILED DESCRIPTION OF THE PREFERRED EMBODIMENT

Figure 1:
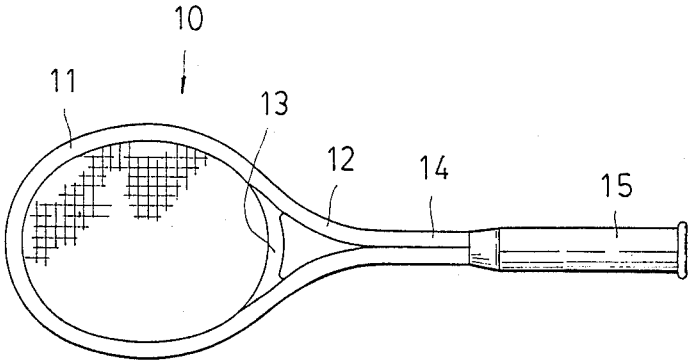
FIG. 1 PRIOR ART
FIG. 1 is a schematic elevational view showing a racket according to the prior art.
Figure 3:
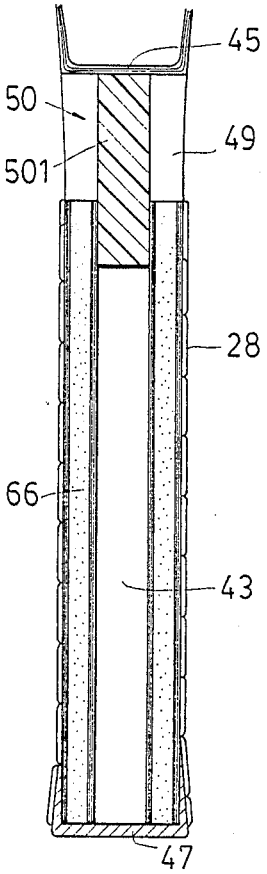
FIG. 3 is a cross sectional view taken along line 3—3 in FIG. 2.

Referring now to FIGS. 2–8, there is shown a preferred embodiment of a racket 20 according to the present invention which includes a head portion 22 including a striking netting 34, a shaft portion 26, a throat portion 24 connected between head portion 22 and shaft portion 26, a grip portion 28 formed on the shaft portion from the bottom end thereof, but excluding the uppermost part, or throat end portion, of shaft portion 26, and a cushioning means 50 provided between head portion 22 and grip portion 28 so as to cushion the impact force occurred when one strikes a ball with striking netting 34.

Grip portion 28 includes a first pair of spaced side plates 42, 44 extending substantially parallel to the plane of striking netting 34, a second pair of spaced side plates 46, 48 substantially perpendicular to striking netting 34 and respectively engaging with plates 42, 44 so as to encompass therebetween a parallelepiped cavity 43, and four side plates 41 each of which is connected between every adjacent two plates 42, 48 (48, 44; 44, 46; 46, 42) of the first and second pairs of spaced plates so that the cross-section of grip portion 28 is octagonally shaped. Parallelepiped cavity 43 can be closed by an end cap 47, and extend beyond grip portion 28 to a stopping surface 45 in the uppermost part of shaft portion 26, or a position where throat and shaft portions 24, 26 interconnect.

Cushioning means 50 includes a transverse through window 49 provided on two side surfaces of shaft portion 26 corresponding to a second pair of spaced plates 46, 48 and between stopping surface 45 and the upper end surface of grip portion 28, and a synthetic foamed core 501 having a shape suitable to be received in cavity 43 and positioned near the uppermost part, or throat end portion of shaft portion 26. Perferably,synthetic foamed core 501 has a length in the longitudinal direction of the racket larger than that of through window 49 and can be of polyethelene elastic rubber.

In order to form parallelepiped cavity 43 and window 49, in a mold, a parallelepiped core 62 and two wing cores 63 are placed in the predetermined positions between plates 42, 44, as compared with the prior art in which the shaft portion is constituted by juxtaposed halves. The remaining two sides of parallelepiped core 62 are respectively engaged by side plates 46, 48 each of which is a parallelepiped shaped framed material core 66 encapsulated in fiber -reinforced fabric plate predipped with thermosetting resin and connected between plates 42, 44. When the tubular fiber fabric plates predipped with thermosetting resin in the mold are satisfactorily compressed by pressurized air (FIG. 4), and then the mold is heat-treated, a racket frame is formed after thermosetting of the resin. When the mold is opened and cores 62, 63 removed, the racket frame so formed will have cavity 43 and window 49. Since the above described is not difficult to be understood for those skilled in the art, no further details will be presented.

Figure 9A:
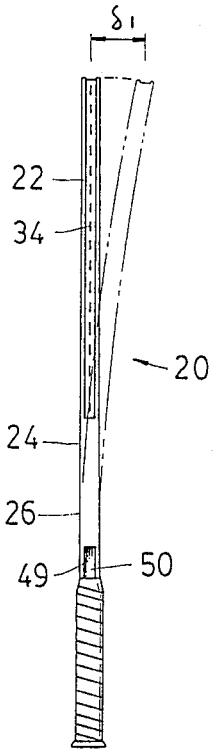
FIG. 9A is a schematic side view showing the deflection of a racket according to the present invention immediately after it has struck a ball.

With the provision of cushioning means 50, the place where cushioning means 50 is provided will form a flexible cushion zone. Referring to FIG. 9A, the impact force when the present racket strikes a ball will be transmitted, through head portion 22, throat portion 24 and shaft portion 26, to the arm of the user. Since the cross-sectional area of shaft portion 26 is suddenly reduced around window 49, a larger strain will be caused when the impact force passes through the area of window 49 so that synthetic foamed core 501 will absorb a substantial amount of the dynamic energy and the impact force reaching the users arm will be greatly decreased, this being why the present racket can free the user from having a "tennis elbow".

Figure 9B:
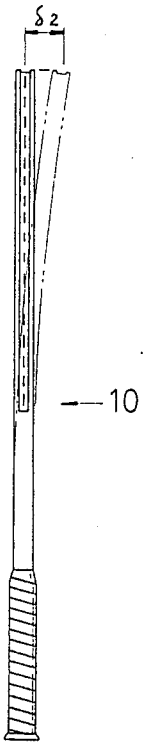
FIG. 9B is a schematic view showing the deflection of a racket according to the prior art immediately after it has struck a ball.
Figure 2:
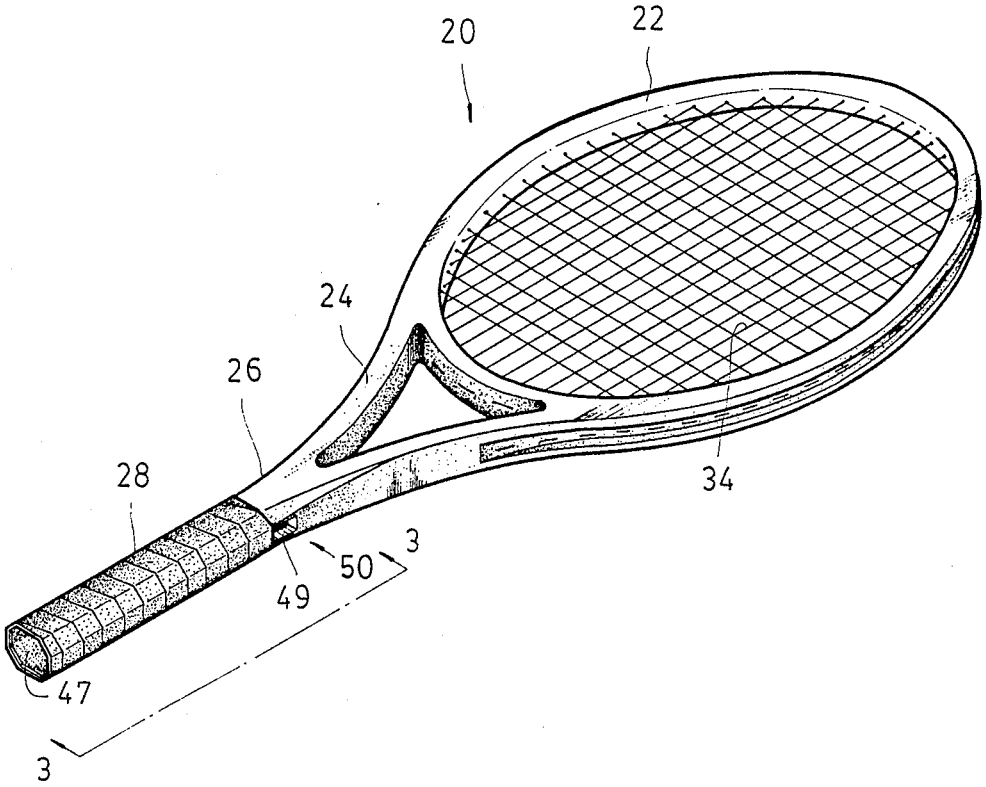
FIG. 2 is a perspectic view showing a preferred embodiment of a racket according to the present invention.

Referring to FIG. 9A & 9B, since the deflection of the present racket 20 is larger than that of the known racket 10, the contact time of the ball contacting with the striking netting will increase, and thus, the present racket 20 will permit a "soft touch" for the user and enable him to have a smart control of the ball.

While the present invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent sturctures.

I claim:

1. A racket comprising:

a head portion;

a striking netting in said head portion extending substantially in a plane;

a shaft portion comprising a throat end portion, a bottom end opposite said throat end portion, a first pair of spaced side plates each extending substantially parallel to said plane of said striking netting, a second pair of spaced side plates each extending substantially perpendicular to said plane of said striking netting and connected respectively with said first pair of spaced side plates to encompass therebetween a parallelepiped shaped cavity;

a throat portion between and connecting said head portion and said throat end portion of said shaft portion;

a traverse window through each of said second pair of spaced side plates substantially oppositely disposed with respect to each other in said throat end portion of said shaft portion and communicating with said cavity;

a grip portion around said shaft portion from said bottom end to an upper end of said grip portion at said throat end portion, but not on said throat end portion; and a synthetic foamed core of impact absorbing material having a shape suitable to be received in said parallelepiped cavity and positioned in said throat end portion, said foamed core extending in the longitudinal direction of said shaft portion for the full length of said window in said longitudinal direction and having a length greater than the length of said window, said foamed core extending part way into said cavity.

2. A racket as claimed in claim 1 wherein:

said synthetic foamed core comprises polyethelene elastic rubber.

3. A racket as claimed in claim 1 wherein:

said second pair of spaced side plates each comprises a core of foamed material encased in fiber reinforced fabric plate impregnated with themosetting resin.

4. A racket as claimed in claim 2 wherein:

said second pair of spaced side plates each comprises a core of foamed material encased in fiber reinforced fabric plate impregnated with themosetting resin.

5. A racket as claimed in claim 1 wherein:

said first and second pairs of side plates are connected by four additional side plates each of which is connected between adjacent first and second side plates to form a grip portion having an octagonal cross section shape.

6. A racket as claimed in claim 4 wherein:

said first and second pairs of side plates are connected by four addtional side plates each of which is connected between adjacent first and second side plates to form a grip portion having an octagonal cross section shape.

7. A racket as claimed in claim 1 wherein:

said foamed core in said throat portion extends across the entire areas of said windows and within said throat end portion of said shaft portion.

8. A racket as claimed in claim 6 wherein:

said foamed core in said throat portion extends across the entire areas of said windows and within said throat end portion of said shaft portion.

9. A racket as claimed in claim 1 wherein:

a stopping surface is disposed transversely in said throat end portion of said shaft portion spaced from said upper end of said grip portion for engaging one end of said foamed core in said throat end portion; and said windows extend from said upper end of said grip portion to said stopping surface.

10. A racket as claimed in claim 8 wherein:

a stopping surface is disposed transversely in said throat end portion of said shaft portion spaced from said upper end of said grip portion for engaging one end of said foamed core in said throat end portion; and said windows extend from said upper end of said grip portion to said stopping surface.

* * * * *